US005898368A

United States Patent [19]

Handley et al.

[11] Patent Number: 5,898,368

[45] Date of Patent: Apr. 27, 1999

[54] TEST INDICATOR CONTROL CIRCUIT FOR SECURITY ALARM DEVICE

[75] Inventors: Lucas Handley, Zephyr; John Peterson, Toronto, both of Canada

[73] Assignee: Digital Security Controls Ltd., Downsview, Canada

[21] Appl. No.: 09/046,734

[22] Filed: Mar. 24, 1998

[51] Int. Cl.[6] ..... G08B 29/00

[52] U.S. Cl. ..... 340/514; 340/506; 340/515

[58] Field of Search ..... 340/514, 515, 340/565, 522, 517, 506

[56] References Cited

U.S. PATENT DOCUMENTS

| | | | |
|---|---|---|---|
| 3,928,849 | 12/1975 | Schwarz | 340/514 |
| 4,743,886 | 5/1988 | Steiner et al. | 340/514 |
| 4,833,450 | 5/1989 | Buccola et al. | 340/506 |
| 5,499,012 | 3/1996 | Tracey | 340/514 |

*Primary Examiner*—Donnie L. Crosland

[57] ABSTRACT

An intrusion detector for monitoring a space has a sensor for generating detection signals in response to detections of events occurring in the space and an indicator for receiving the detection signals and for generating detection indications in response thereto. A controllable switch is operably interposed between the sensor and the indicator and operates to connect or disconnect the sensor and the indicator. A switch control circuit is connected to the switch. A test trigger device is connected to the control circuit to generate an initiate-test signal to the control circuit. The control circuit is also connected to the sensor and receives and counts detection signals. The control circuit controls the operation of the switch by generating a switch control signal in response to the initiate-test signal and to the counting of detection signals.

8 Claims, 6 Drawing Sheets

TEST INDICATOR CONTROL CIRCUIT FOR SECURITY ALARM DEVICE

FIELD OF THE INVENTION

This invention relates to a control circuit in a security alarm device to control the operation of a test indicator therein.

BACKGROUND OF THE INVENTION

Various security alarm devices are well known in the art. These devices sense various physical parameters in a space being monitored to detect unusual conditions indicating the presence of a potential alarm situation. There are many types of such devices, such as for example motion detectors based on detection of changes in infrared radiation patterns, motion detectors based on reflection of microwave or of ultrasonic signals transmitted into the space, vibration sensors, contact detectors, glassbreak detectors and so on. Some detectors combine different technologies into a single device.

Each of the devices in a security system is connected to communicate to an alarm panel. The panel monitors the status of all of the devices in the system and the system as a whole. When a valid alarm condition arises, the panel communicates same, usually by the public telephone system, to an outside agency such as the police or more commonly in recent years an alarm monitoring agency.

As is also well known in the art, many alarm devices, in addition to their primary sensing functions, have a tamper alarm associated with them. If a tamper sensor in the device (frequently, a tamper switch held in a normal position) is disturbed, the device reports an alarm condition to the panel.

It is desirable to test the proper operation of an alarm device when it is initially installed and, thereafter, on a regular basis.

Some alarm devices, e.g. passive infrared (PIR) motion detectors and microwave motion detectors, are quite directional in their coverage. A PIR detector, in particular, defines via its lens and sensor sub-systems a very specific coverage pattern in which there are multiple zones. Consequently, when detectors of this kind are installed, they should be properly aligned to provide the proper coverage in the premises to be protected. Subsequently, after installation, their continued proper alignment should be periodically checked.

The testing and checking of an alarm device is frequently done by means of a walk-test. To perform a walk-test, for example on a PIR motion detector, the person doing the test carefully walks through the space intended to be monitored by the detector. As he walks through the space, he watches for a detection response from the detector. Usually, the detector is provided with a small lamp, such as an LED, which lights when a detection has been sensed. In this manner, the person can assess whether the detector is identifying movement in the proper physical space where it is desired to detect such movement. If necessary, the detector can be adjusted or replaced to provide the correct coverage. As will be appreciated, a proper walk-test should be done carefully.

In a conventional hard-wired system, namely a system in which the various alarm devices draw their power from either the AC power lines or from a central power source, conserving energy at the device typically is not a primary consideration. Accordingly, in such systems, the walk-test indicator lamp can be permanently enabled, such that even when no specific walk-test is being done the walk-test lamp will light when a detection occurs. This means that, for example in an office setting, during the day as people walk by the detector, the walk-test lamp would be constantly turning on and off.

Such continuous detection activity would, however, represent an unnecessary energy drain on a battery-powered, wireless detection device. Accordingly, it is desirable in a wireless device to have all circuits active only when it is necessary for them to be active. This means enabling them and disabling them under the appropriate conditions or at the appropriate times. Thus, a walk-test circuit or lamp should only be enabled or engaged when it is necessary to perform a walk-test.

U.S. Pat. No. 5,499,012 discloses such a system in which operation of a tamper switch triggers enablement of the walk-test circuit and also operation of a timer. When a predetermined time is reached, the walk-test circuit is disabled. In other words, a limited period of time is available during which a walk-test can be performed. At the end of the pre-determined period, the ability to continue with a walk-test is terminated. To operate the tamper switch in the first place, it is usually necessary for the user to climb up (on a ladder, chair or the like) to reach the device because typically the alarm devices are often placed up high where they are not easily or accidentally disturbed.

The design disclosed in U.S. Pat. No. 5,499,012 can however be problematic. If the walk-test period is set too short and a walk-test has not been concluded when the timer times out, the user may simply not proceed further with the test because he would have to climb-up to the sensor a second time, operate the tamper switch again, and then proceed with the test, all of which may be inconvenient. The result would be an incomplete and unreliable test. Even if the user makes the effort to climb-up and operate the tamper switch again, in a second test, the positioning of the detector may have been disturbed or changed by the second operation of the tamper switch with the result that the second test may not quite match up or be aligned with the partial and incomplete first test. The continuity, reliability and thus results of the walk-test may therefore be suspect. Alternatively, if the user knows in advance that there is insufficient time for conducting a complete and careful proper walk-test, then he may be encouraged to perform the walk-test quickly with less precision and care than would be desired. The result in all such cases would be that the test may not be reliable.

On the other hand, if the walk-test period is set too long, then there may be many more detections than is necessary (for example, after the walk-test per se has been concluded, other people walk by the detector causing detections to be annunciated on the walk-test lamp) with attendant unnecessary energy drain on the battery.

In addition to the above, it will be appreciated, that different people will take different amounts of time to conduct a proper walk-test according to their personal preferences. As a result, it can be difficult or impossible to set a single pre-determined time which would be satisfactory to all users.

SUMMARY OF THE INVENTION

In accordance with one embodiment of the invention, the invention is an intrusion detector or system for monitoring a space or zone which includes sensing means to generate detection signals in response to detections of events occurring in the space or zone. An indicating means receives the detection signals and generates detection indications in response thereto. A controllable switch means is operably interposed between the sensing means and the indicating means and operates to connect or disconnect the sensing means and the indicating means. A switch control means is connected to the switch means. A test triggering means is connected to the control means to generate an initiate-test signal to the control means. The switch control means is also connected to the sensing means and receives and counts detection signals. The control means controls the operation of the switch means by generating a switch control signal in response to the initiate-test signal and to the counting of detection signals.

In accordance with another embodiment of the invention, the invention is a control circuit in an intrusion detector or system for monitoring a space or zone said detector having a sensing means for generating detection signals in response to detections of events occurring in the space or zone and indicating means for receiving the detection signals and for generating detection indications in response thereto. It comprises controllable switch means is operably interposed between the sensing means and the indicating means and operates to connect or disconnect the sensing means and the indicating means. A switch control means is connected to the switch means. A test triggering means is connected to the control means to generate an initiate-test signal to the control means. The switch control means is also connected to the sensing means and receives and counts detection signals. The control means controls the operation of the switch means by generating a switch control signal in response to the initiate-test signal and to the counting of detection signals.

In accordance with yet another embodiment of the invention, the invention is a process for controlling the operation of an indicating means in an intrusion detector in response to detection signals generated by sensing means in the intrusion detector. The process comprises connecting the sensing means and the indicating means in response to an initiation signal, then counting the number of detection signals generated by the sensing means and then disconnecting the indicating means and the sensing means when the count of said detection signals reaches a pre-determined number.

The various features of novelty which characterize the invention are pointed out with particularity in the claims annexed to and forming a part of this disclosure. For a better understanding of the invention, its operating advantages and specific objects obtained by its use, reference should be had to the accompanying drawings and descriptive matter in which there are illustrated and described preferred embodiments of the invention.

DETAILED DESCRIPTION OF A SPECIFIC EMBODIMENT

Figure 1:
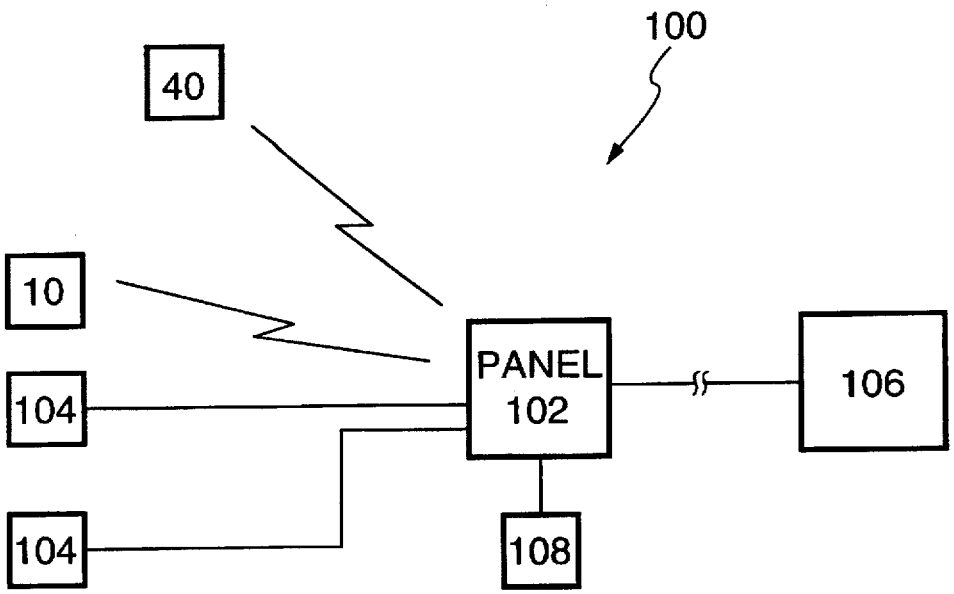
FIG. 1 is a block diagram of an alarm system in which a device according to the invention may be used.

Referring to FIG. 1, an alarm system is shown generally as 100. System 100 comprises panel 102 to which various alarm detection devices 104 are connected. At least one of such devices is a wireless alarm detection device 10 according to one embodiment of the invention. Another of such devices may be a wireless alarm detection device 40 according to another embodiment of the invention. Panel 102 is connected to communicate to an external alarm service 106. Panel 102 may also be connected to control the operation of a local alarm annunciation device 108, such as a siren, bell or other sounder device.

Figure 2:
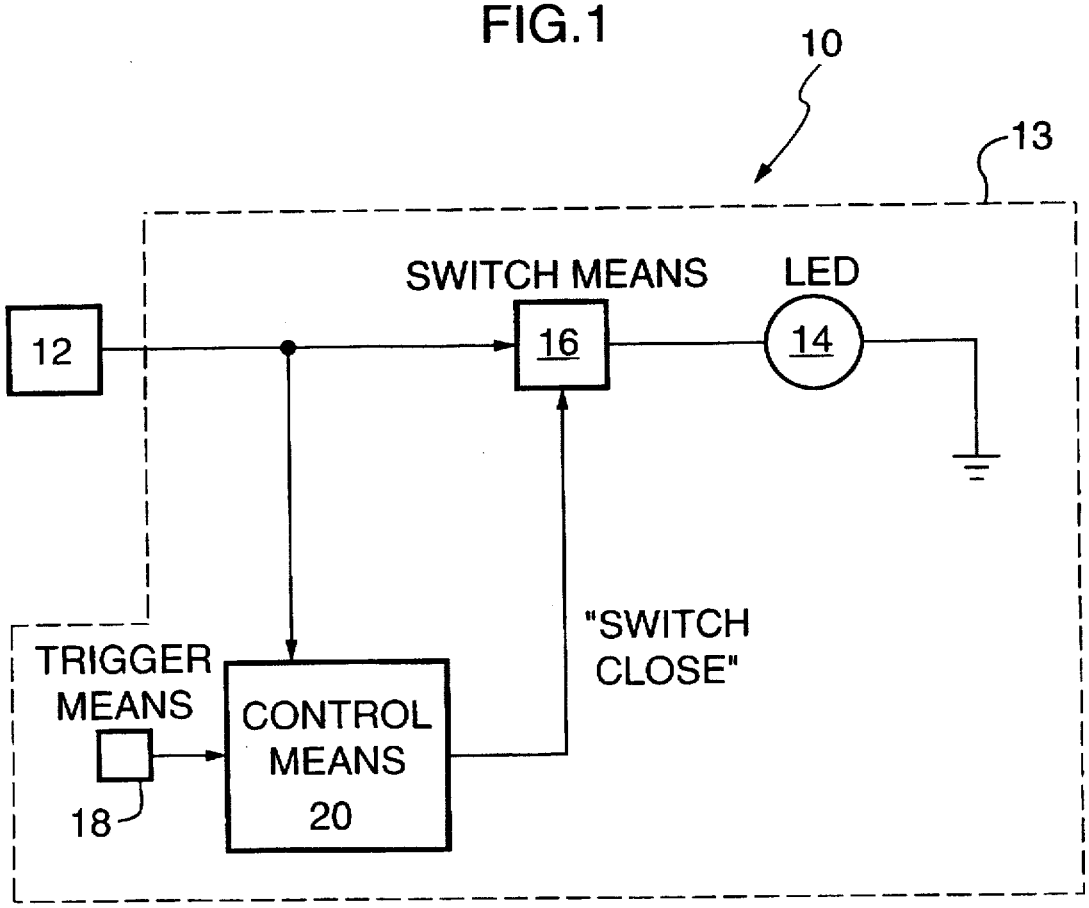
FIG. 2 is a block diagram of an alarm detection device according to the invention.

Referring to FIG. 2, a battery-powered alarm detection device 10 according to the invention is shown in greater detail. Alarm detection device 10 contains alarm detection and transmission circuitry 12 which, when an alarm event is detected, generates a detection signal according to the conventional design of the detector 12. The detection signal, together with any relevant data relating to same, is transmitted in conventional manner by detection and transmission circuitry 12 to the remote alarm panel 102.

A walk-test circuit according to the invention, indicated generally as 13, is connected to detection and transmission circuitry 12 to receive the detection signal. More particularly, detection and transmission circuitry 12 is connected to the walk-test indicator 14, usually an LED lamp, through switch means 16. For a detection signal from detector 12 to reach lamp 14, switch means 16 must be in the closed position.

Control means 20 is connected to switch means 16 to control the operation of same. Alarm detector 12 is also directly connected to control means 20 whereby a detection signal is passed directly to control means 20.

In normal operating conditions, switch means 16 in fact will be in the open position, so that a detection signal in fact will not reach lamp 14 and therefore no energy will be wasted powering lamp 14 during normal operating conditions.

It is only necessary to close switch means 16 when it is desired to perform a walk-test of device 10. Accordingly, a walk-test trigger means 18 is provided and connected to control means 20. The walk-test trigger means 18 must be manually operated when it is desired to conduct a walk-test. When the walk-test trigger means 18 is actuated and a trigger signal passed to control means 20, control means 20 in turn issues a "switch close" signal to switch means 16. Control means 20 maintains the "switch close" signal for as long as the walk-test continues.

Control means 20 operates to count the number of detections, i.e. the number of detected events, generated by detector 12. When a pre-determined number of detections has been counted, control means 20 removes the "switch close" signal to switch means 16, thus allowing switch means 16 to revert to the normally open position.

Figure 3:
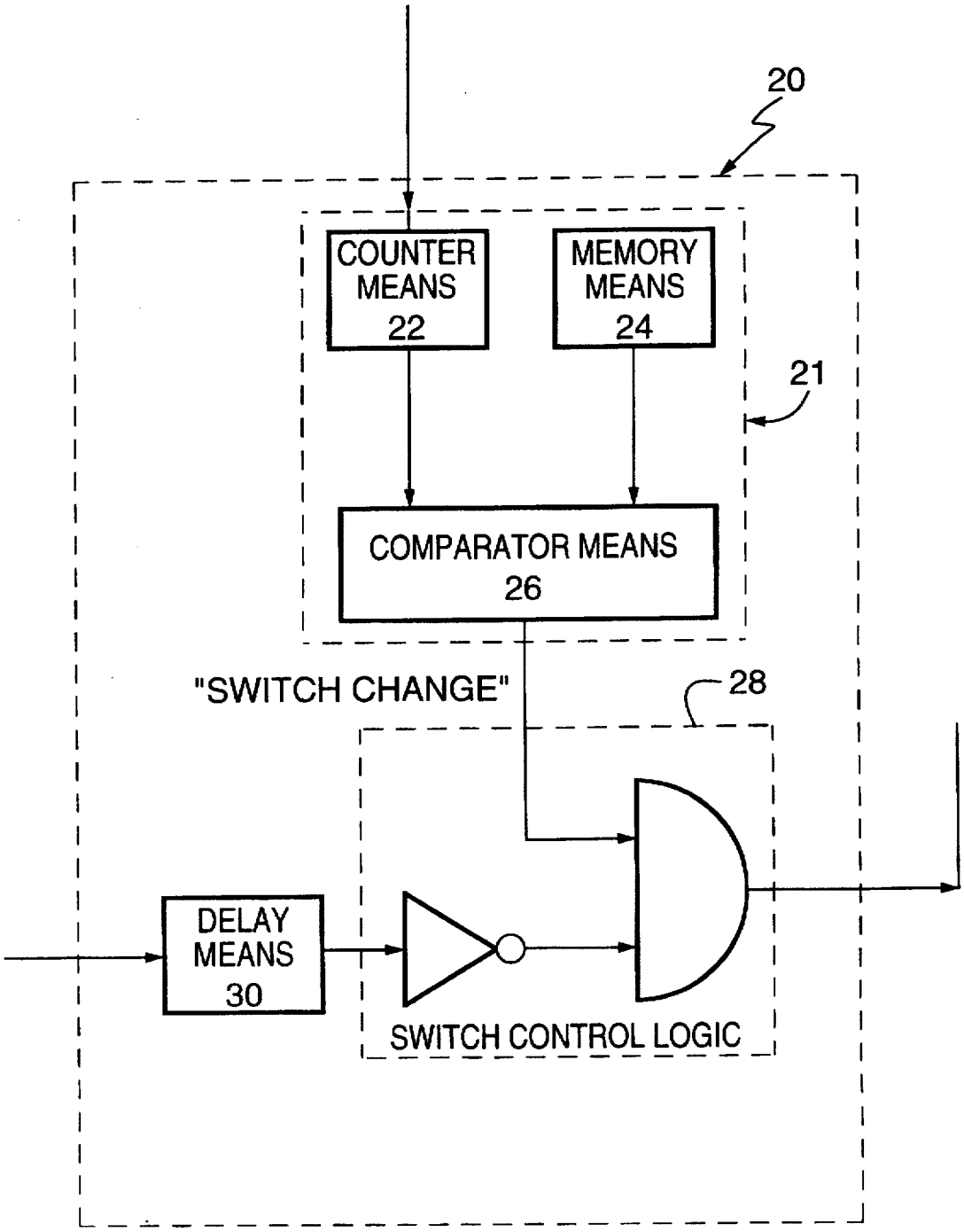
FIG. 3 is a more detailed block diagram of a component of the device shown in FIG. 2.

Referring now to FIG. 3, a specific embodiment of control means 20 is shown in greater detail. An alarm detection signal is passed to count-down means 21 which functions to count down from a pre-determined count number and at zero to issue a "switch change" signal. The predetermined target count number could be pre-determined and set at the factory or it could be programmed on site by an installer.

One embodiment of count-down means 21 is illustrated in greater detail. In particular, counter means 22 counts the number of detection signals received from detector 12. The pre-determined target count number is stored in memory means 24. The output of counter 22 and the predetermined target number are compared in comparator means 26. When the count matches the target count number, comparator means 26 generates the "switch change" signal.

Other count down means could be used, such as for example a programmable count down means.

The "switch change" signal is input to switch control logic 28. Switch control logic 28 also receives the trigger signal from the walk-test trigger means 18. Logic 28 generates the "switch close" signal only when the walk-test trigger means 18 has been triggered and no "switch change" signal has been generated by comparator means 26.

Appropriate resetting means would be included, but is not shown.

It may be desirable to have delay means 30 interposed between walk-test trigger means and logic means 28. Delay means 30 operates to generate a delayed trigger signal after a pre-determined delay period.

Walk-test trigger means 18 may be a dedicated switch on detector device 10.

Figure 4:
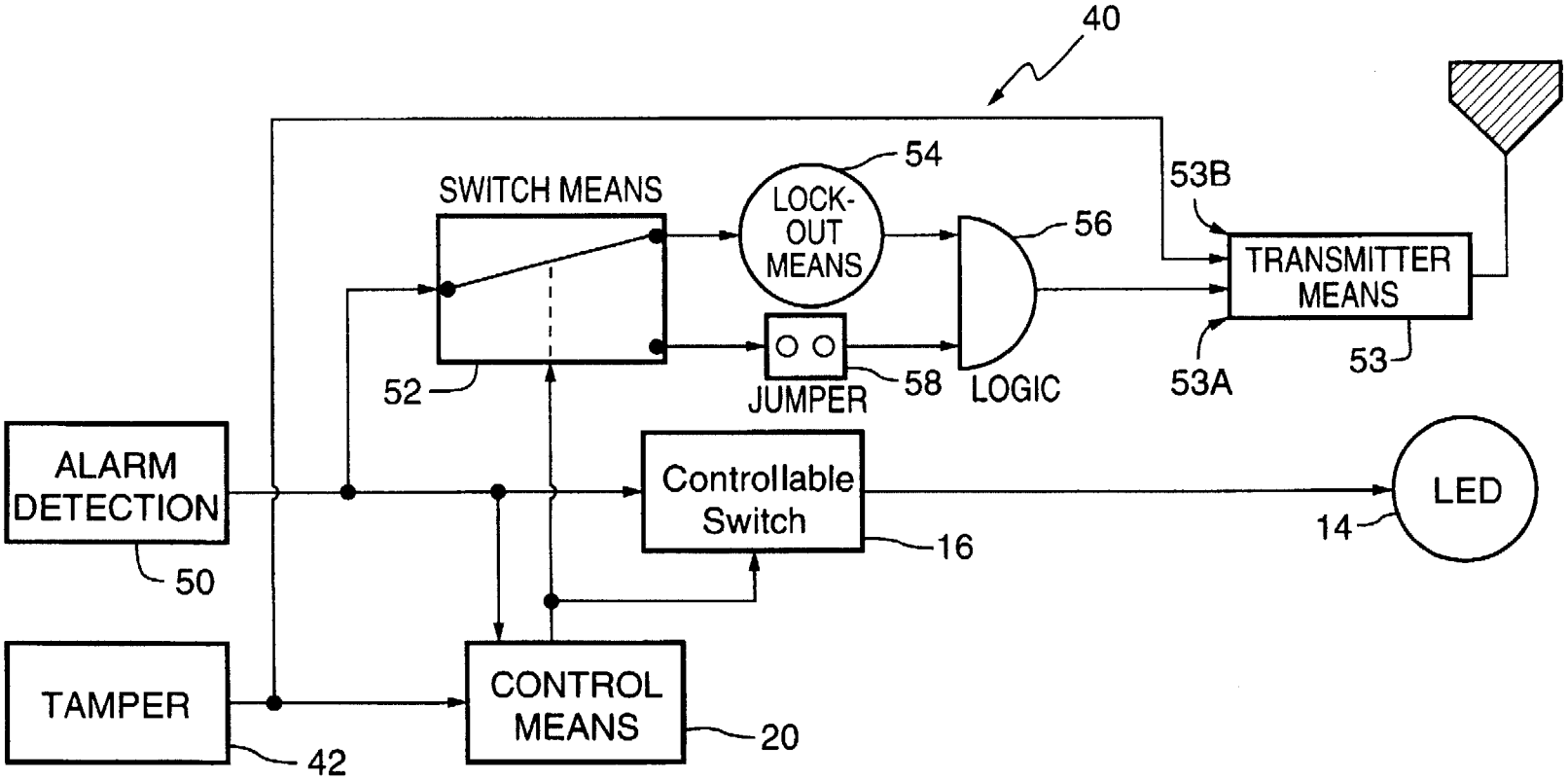
FIG. 4 is a block diagram of an alternate embodiment of an alarm detection device according to the invention.

However, as described above, it is known in the art to provide a tamper switch which if disturbed will cause a detector to transmit an alarm condition to the remote alarm panel. As shown in FIG. 4, in a device 40 with such a tamper switch 42, the tamper switch 42 may serve the further purpose of the walk-test trigger means 18. In other words, a tamper switch 42 may replace a dedicated walk-test trigger means 18.

Because device 40 will report the tripping of tamper switch 42 as an alarm condition, the remote panel 102, or ultimately the remote monitoring service 106, must be aware of the difference between a true tamper alarm condition and a tripping of the tamper switch 42 for the purpose of conducting a walk-test. This may be accomplished according to whether alarm system 100 is in an armed or a disarmed state. If it is desired to perform a walk-test, the user must ensure that system 100 is placed in the disarmed state. If it is not a test situation and it is desired to interpret tamper signals as true alarm conditions, the user must place system 100 in the armed state. Accordingly, in this manner, when tamper switch 42 is triggered when the system 100 is disarmed, a tamper detection report received by panel 102 from detector 40 will be interpreted as a walk-test situation, not a true alarm. Panel 102 will not take action to initiate any alarm report to central monitoring service 106.

Alternatively, panel 102 may be equipped to be placed into a special walk-test mode during which tamper events will not be reported to service 106.

As yet a further alternative, an authorized person wishing to do a walk-test may contact the remote monitoring service 106 in advance and inform them he is about to do a walk-test. Accordingly, if panel 102 is configured to always report any tamper event to service 106, service 106 will know to ignore any tamper event transmission received during the walk-test.

Another component of a battery-powered, wireless alarm detector which may require particular attention is the transmitter component. If the transmitter transmits too frequently it may unnecessarily drain the limited energy available to the detector. Conventional theory is that only one transmission is sufficient to identify an alarm. Multiple alarms and multiple transmissions caused by the same intrusion event, for example as an intruder walks through the various zones of a PIR detector, offer no additional information and thus represent an unnecessary energy drain. Accordingly, it is known to disable, or lockout, a transmitter for a fixed period of time (for example, 2 minutes) after a first alarm transmission has been sent.

Applicant has conceived that, in certain circumstances like a walk-test situation, it may in fact be desirable to operate the transmitter with each alarm detection, in spite of the potential for energy drain—for example, to test the transmitter's operation to ensure that its signal is being properly transmitted and received. Panel 102 may confirm reception by causing sounder device 108 to operate, which will be heard remotely by the person doing the walk-test, thus confirming to him both proper transmission and reception.

Accordingly, in some instances, it may be desirable to disable the transmitter and in others to enable the transmitter. Thus, in an alternate embodiment of the invention, control means 20 in conjunction with other circuitry described below may be used to effect such transmitter enablement and disablement.

Referring to FIG. 4, means are illustrated to control the enablement and disablement of transmitter means 53. In normal transmission operation, transmitter means 53 accepts a processed alarm detection signal at input 53A and a tamper alarm signal at input 53B. Transmitter means 53 then processes these inputs to prepare an appropriate coded data stream for transmission. For example, a code for a tamper alarm may be combined with unique pre-programmed identification indicia for device 40 into a data stream which will identify the device and report that its tamper alarm has been tripped.

In normal operation, controllable switch means 52 passes an alarm detection signal to lock-out means 54 which functions to inhibit, during a pre-determined time after a first alarm detection signal, any further alarm detection signals from being transferred to transmitter means 53.

In the same manner described previously, the output of tamper switch 42 is used to initiate the operation of control means 20. In the present embodiment, in addition to the output of control means being connected to controllable switch means 16, it is also connected to controllable switch means 52. Accordingly, a tamper signal through control means 20 will change the position of controllable switch means 52. Through a manual jumper 58 (or other selection means), a detection signal bypasses lock-out means 54 and is passed directly to through logic 56 to transmitter means 53.

In such embodiment, it may be preferred to rely entirely on the operation of the remote sounder device 108. Accordingly, it may be preferable to eliminate entirely the local indicator lamp 14 from the circuit.

Figure 5:
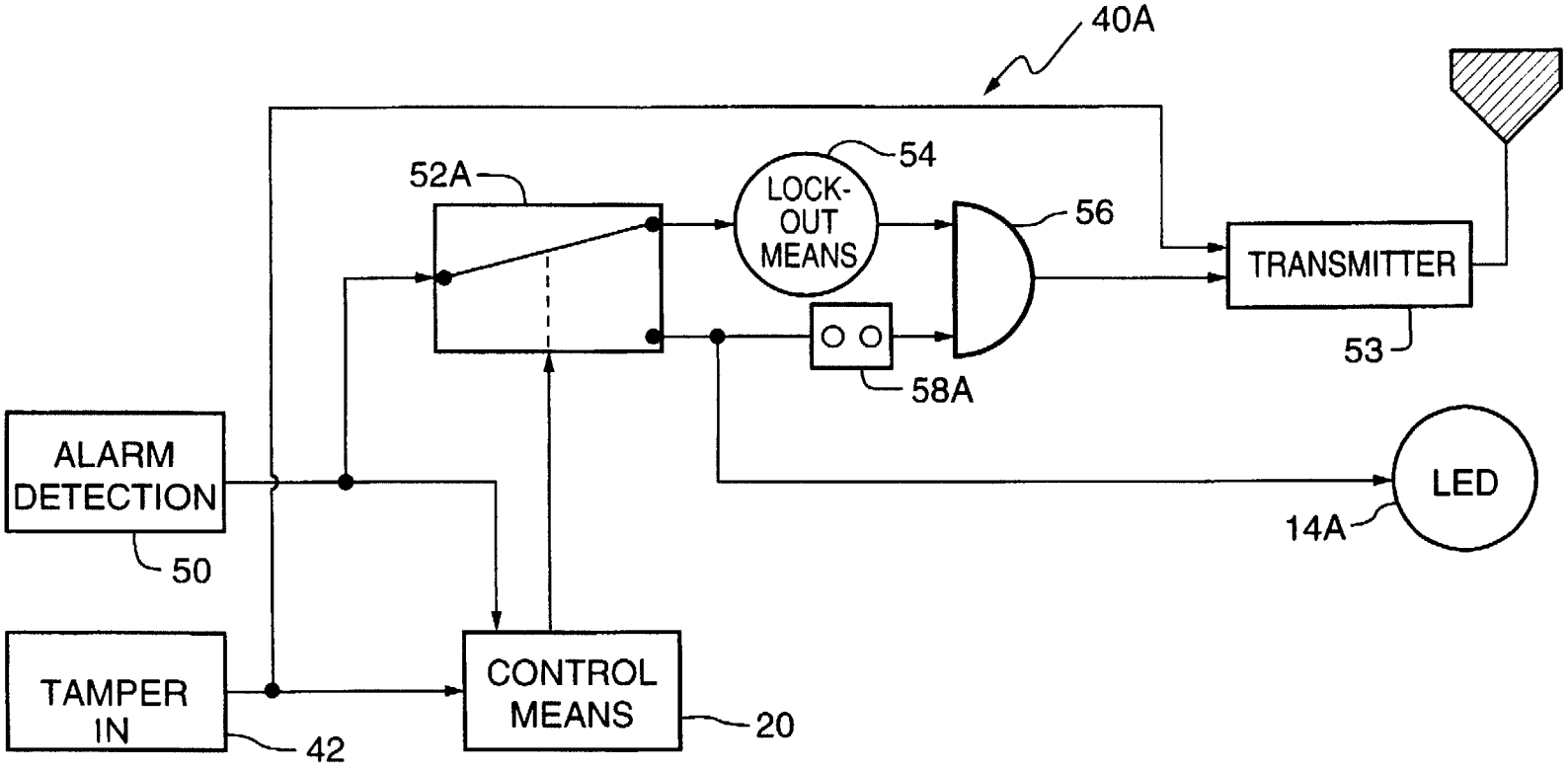
FIG. 5 is a block diagram of an alternate embodiment of an alarm detection device according to the invention.

Referring to FIG. 5, alternate means are illustrated to control the enablement and disablement of transmitter means 53 in device **40*a*. In the same manner described previously, the output of tamper switch 42 is used to initiate the operation of control means 20. In the present embodiment, however, only one controllable switch means 52*a* is used. Accordingly, a tamper signal through control means 20 will change the position of controllable switch means 52, thus enabling indicator lamp 14*a*. Through a manual jumper 58*a* (or other selection means), a detection signal bypasses lock-out means 54 and is passed directly to through logic 56 to transmitter means 53**.

Figure 6:
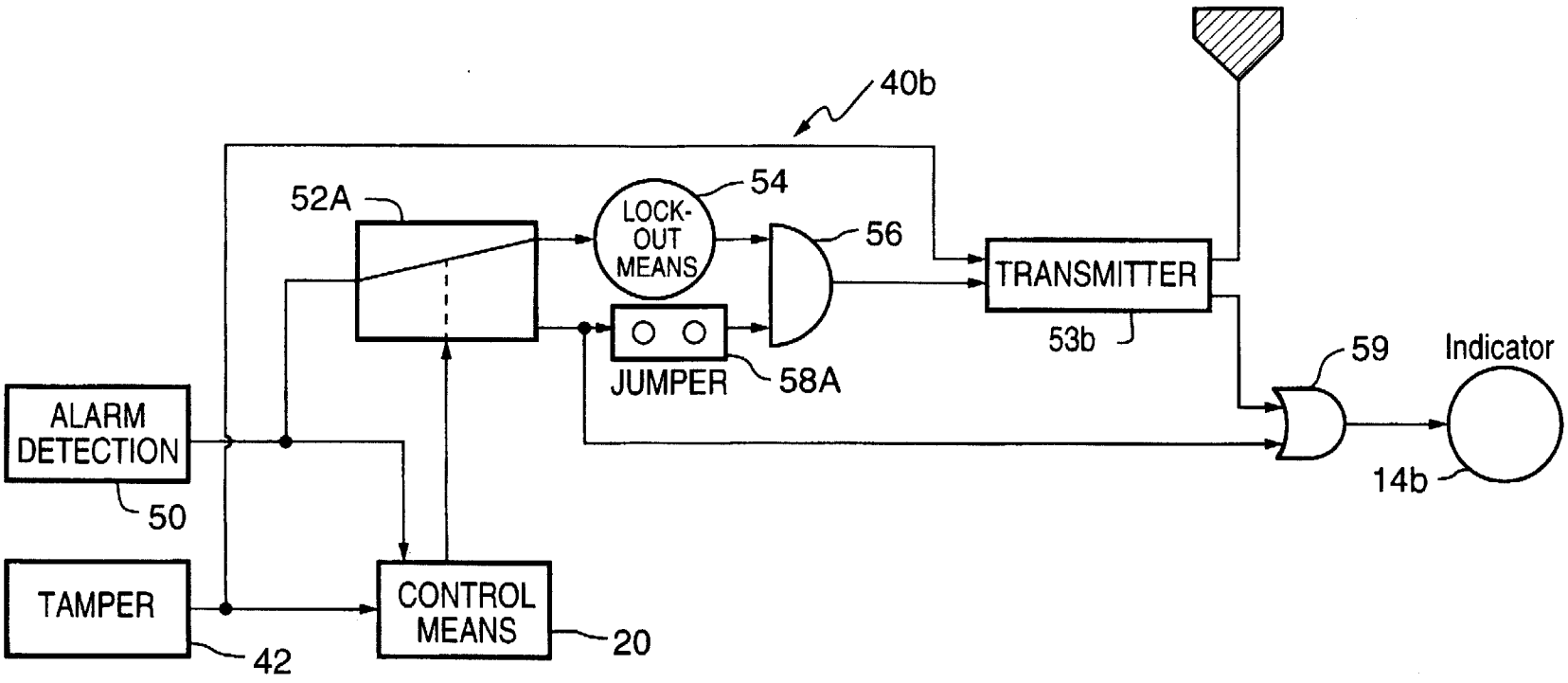
FIG. 6 is a block diagram of an alternate embodiment of the alarm detection device of FIG. 5.

Referring to FIG. 6, other means are illustrated to control the enablement and disablement of the indicator lamp in device 40b. In this embodiment, transmitter means 53b is operable, each time it is enabled to transmit, to provide an output signal to OR gate 59. Through OR gate 59, every detection signal and every tamper signal thus triggers indicator means 14b, which could advantageously be in this embodiment a sound emitting device. Every time transmitter means 53b is enabled, the indicator would be triggered; in effect, the indicator means becomes a transmission indicator. This embodiment may be particularly useful in detectors in which the sensing elements are not constantly activated by every day use and yet for which there may be conditions that should be brought to the attention of the user. For example, as is commonly done in smoke detectors, a low battery condition sensed by the device could be annunciated by the "chirp" of a sound emitting device. In other devices, unusual device transmissions may indicate trouble in the device requiring the attention of the user.

In operation, a user who desires to conduct a walk-test will first ensure that the system 100 is disarmed. He will then trigger the walk-test switch 18 or tamper switch 42, as the case may be. For the typically placed detector 10, he would have to climb-up on a ladder or chair to do so. The brief delay established by delay means 30 allows time for the user to get off the ladder or chair without triggering relevant detection events. After the delay period expires, a delayed trigger signal is generated to logic means 28. Such triggering would cause logic means 28 to generate a "close switch" signal which is communicated to switch means 16. Switch means 16 then closes, thus creating a signal path from alarm detector 12 to lamp 14. The user may then at his leisure carefully and precisely conduct a walk-test without any artificial time pressures and without having to climb-up the ladder again.

As the user performs the walk-test, sequential detection signals would be generated and counted in counter means 22. When the count reaches the pre-determined target count number in memory 24, comparator 26 generates a "switch change" signal which via logic means 28 causes removal of the "switch close" signal and thus allows switch means 16 to open. The opening of switch means 16 terminates the walk-test.

The pre-determined target count number stored in memory means 24 is selected so that it is large enough to allow a proper walk-test to be performed for the particular type of detector, but not so large that it will be an undue drain on the battery before the walk-test is terminated. For example, if a PIR detector will trigger, say, 20 detection events during a careful and proper walk-test as the user walks through the zones of the PIR, then the target number might be set at, say, 25. This would allow the user to conduct a full and proper walk test and even repeat some of it. If, after conducting the walk-test and getting 20 detections, the user was fully satisfied with the performance of the device and he then moved away from the unit, there would still be 5 counts left on the counter. The unit would continue indefinitely to stay enabled to do further walk-testing. However, because the walk test is being done in the disarmed state, the normal activities of people in the premises during the disarmed state will cause the counter to reach the target number. That is, persons who happen normally to pass by, will be detected, which detections will be added to the count until the count reaches the target number. When the count reaches the pre-determined number, then switch means 16 opens thus disabling further communication of detection signals to lamp 14.

The system of the invention has been particularly described above in connection with a stand-alone intrusion detector device in which the physical components of the inventive circuitry are closely associated together in or as part of the device. It will be appreciated however that in a two-way system, for example a hard-wired system in which the detector devices are capable of two-way communication with the alarm panel, the components of the inventive system could be physically separated with some components being located at the panel and others at the device.

Figure 7:
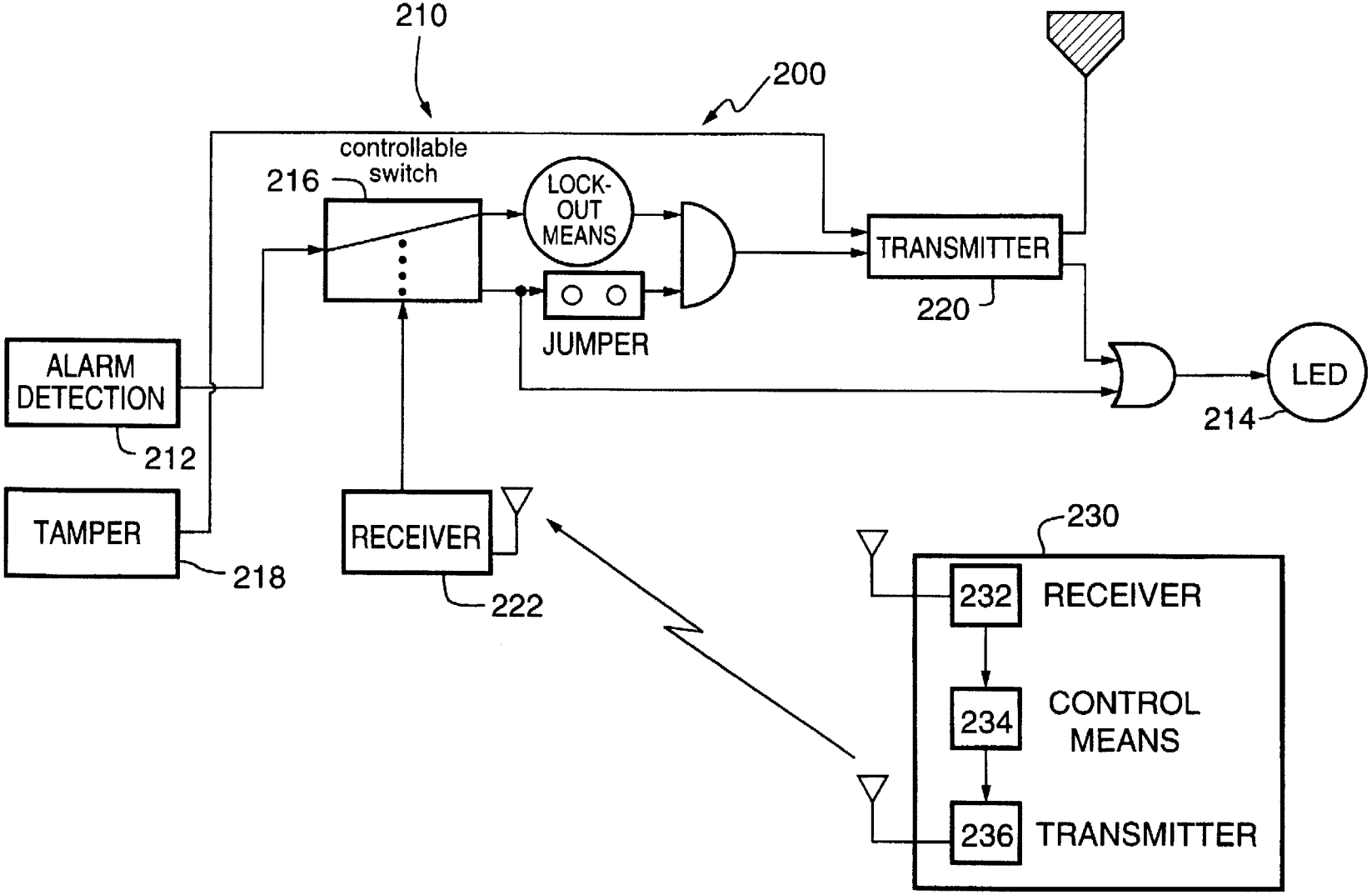
FIG. 7 is a block diagram of an alternate embodiment of an alarm detection system according to the invention.

Referring for example to FIG. 7, such a two-way system is shown generally as 200. In the illustrated embodiment, the communication channels are established by RF transmission, but they could be by any other suitable means, such as by hard-wired, infrared or ultrasonic structures and protocols. The alarm device, generally indicated as 210, is connected to panel 230 via the communication channels. In device 210, alarm detector 212 is connected to alarm indicator means 214 through controllable switch means 216, in the manner previously described above. Alarm detection signals and tamper signals are likewise delievered to transmitter 220 in the manner generally described above. Receiver means 222 is connected to switch means 216 to control same in accordance with signals received from remote panel 230.

Panel 230 incorporates a receiver 232 for receiving the signals transmitted by transmitter 220. Receiver 232 in turn passes those signals to control means 234 which in turn is connected to transmitter 236. In the manner generally described above, control means 234 operates to, upon receipt of a tamper signal, send a "close switch" signal to receiver 222 via transmitter 236. Control means 234 then counts a pre-determined number of alarm detections and then sends a "change switch" signal to receiver 222 again via transmitter 236.

Using the system according to the invention, the person conducting the walk-test may conduct a careful and precise walk-test, without artificial time pressures. In addition, use of the circuit according to the invention allows for more carefully controlled use of energy, particularly important in a battery-powered, wireless device. Each walk-test essentially represents a known amount of energy drain.

The system of the invention has been particularly described in connection with a battery-powered alarm device. It will be appreciated that the system of the invention could as well be used in any alarm device in which it is desired to control the enablement or disablement of an indicator lamp—for example, in a hard-wired alarm system in which the entire system must have a battery-powered back-up power supply or in any device on which it is not desired to have an intrusion detection indicator except during test conditions (so as not to betray the device's detection pattern to unauthorized persons).

The foregoing is a description of preferred embodiments of the invention which is given here by way of example only. The invention is not to be taken as limited to any of the specific features as described but comprehends all such variations thereof as come within the scope of the appended claims.

What is claimed is:

1. An intrusion detector for monitoring a space comprising:

a sensing arrangement for generating detection signals in response to detections of events occurring in the space;

a visual indicator for receiving the detection signals and for generating detection indications in response thereto;

a controllable switch operably interposed between the sensing arrangement and the visual indicator for connecting or disconnecting the sensing arrangement and the visual indicator;

a control arrangement connected to the switch means;

a test triggering member connected to said control arrangement for generating an initiate-test signal to said control arrangement; and wherein said control arrangement is also connected to the sensing arrangement for receiving and counting detection signals whereby the control arrangement controls the operation of said controllable switch by generating a switch control signal in response to the initiate-test signal and to the counting of detection signals.

2. A control circuit in an intrusion detector for monitoring a space said detector having a sensing means for generating detection signals in response to detections of events occurring in the space and indicating means for receiving the detection signals and for generating detection indications in response thereto comprising:

controllable switch means operably interposed between the sensing means and the indicating means for connecting or disconnecting the sensing means and the indicating means;

switch control means connected to the switch means;

test triggering means connected to said control means for generating an initiate-test signal to said control means; and wherein said switch control means is also connected to the sensing means for receiving and counting detection signals whereby the control means controls the operation of the switch means by generating a switch control signal in response to the initiate-test signal and to the counting of detection signals.

3. A process for controlling the operation of an indicator of an intrusion detector in response to detection signals generated by a sensing arrangement of the intrusion detector, said process comprising:

temporarily electrically connecting the sensing arrangement and the indicator in response to an initiation signal to activate said indicator when a detection signal is generated;

counting the number of detection signals generated by the sensing arrangement; and disconnecting the indicator and the sensing arrangement when the count of said detection signals reaches a predetermined number.

4. A detector in accordance with claim 1 wherein said test triggering member comprises a tamper switch.

5. A detector in accordance with claim 1 wherein said test triggering member further comprises a delayed trigger for delaying the generating of an initiate-test signal.

6. An intrusion detection system for monitoring events in a zone to be protected comprising:

a sensor for generating detection signals in response to detections of events occurring in the zone;

an indicator for receiving the detection signals and for generating detection indications in response thereto;

a controllable switch operably interposed between the sensor and the indicator for connecting or disconnecting the sensor and the indicator;

a switch control circuit operably connected to said controllable switch;

a test triggering actuator operably connected to said switch control circuit for generating an initiate-test signal to said switch control circuit; and wherein said switch control circuit is also operably connected to the sensor for receiving and counting detection signals whereby the switch control circuit controls the operation of the controllable switch by generating a switch control signal in response to the initiate-test signal and to the counting of detection signals.

7. A control system in an intrusion detection system for monitoring a zone to be protected said detection system having sensing means for generating detection signals in response to detections of events occurring in the zone and indicating means for receiving the detection signals and for generating detection indications in response thereto comprising:

controllable switch means operably interposed between the sensing means and the indicating means for connecting or disconnecting the sensing means and the indicating means;

switch control means operably connected to the switch means;

test triggering means operably connected to said control means for generating an initiate-test signal to said control means;

switch control means also operably connected to the sensing means for receiving and counting detection signals whereby the control means controls the operation of the switch means by generating a switch control signal in response to the initiate-test signal and to the counting of detection signals.

8. A system in accordance with claim 6 wherein said switch control circuit is remote from said sensor and said controllable switch and is operably connected therewith by sending and receiving communication channels.

* * * * *